US006789797B2

(12) United States Patent
Vincent

(10) Patent No.: US 6,789,797 B2
(45) Date of Patent: Sep. 14, 2004

(54) PSYCHOLOGICALLY OPTIMIZED MYSTERY PARTY GAME

(76) Inventor: Cindy W. Vincent, 3207 Mill House Run, Missouri City, TX (US) 77459

( * ) Notice: Subject to any disclaimer, the term of this patent is extended or adjusted under 35 U.S.C. 154(b) by 0 days.

(21) Appl. No.: 10/222,513

(22) Filed: Aug. 16, 2002

(65) Prior Publication Data

US 2004/0032082 A1 Feb. 19, 2004

(51) Int. Cl.[7] ..... A63F 3/00
(52) U.S. Cl. ..... 273/236; 273/459
(58) Field of Search ..... 273/236, 459, 273/461, 243, 292, 308, 254

(56) References Cited

U.S. PATENT DOCUMENTS

| | | | | | |
|---|---|---|---|---|---|
| 2,099,611 | A | * | 11/1937 | Levoy | 273/308 |
| 2,165,891 | A | * | 7/1939 | Freedman | 273/243 |
| 2,189,477 | A | * | 2/1940 | Sleeth | 273/308 |
| 4,053,154 | A | * | 10/1977 | Niemann | 273/243 |
| 6,158,742 | A | * | 12/2000 | Platt | 273/292 |
| 6,446,968 | B1 | * | 9/2002 | Koch | 273/243 |

FOREIGN PATENT DOCUMENTS

| | | | | |
|---|---|---|---|---|
| AU | 132253 | * | 4/1949 | 273/236 |
| GB | 586817 | * | 4/1947 | 273/243 |

* cited by examiner

*Primary Examiner*—Benjamin Layno
(74) *Attorney, Agent, or Firm*—Barber Legal; Craig W. Barber

(57) ABSTRACT

A mystery role playing game system optimized for children suitable in terms of level of difficulty for all participants; that does not require any participant to play the role of a criminal and/or "bad guy", that allows responsible supervision of the course of the game, that provides positive social rewards to a selected individual (for example a particular child whose birthday party is the occasion for the game), that provides a carefully structured format for progression of the game, and which includes one or more modest "physical" challenges such as hunts for treasure and/or clues. A central "detective" character may supervise other player's rounds, and non-player supervisors may also supervise revelation of each character's clues. Non-player characters may take the negative roles (such as suspects), and the central character may have sufficient information to solve the mystery at the end of the game.

10 Claims, 6 Drawing Sheets

Supervisor's Reference Materials

Including:

* information allowing player introduction of a crime
* information allowing introduction of the scene of a crime
* information allowing introduction of a plurality of suspects
* information allowing introduction of a background
* directions as to the order in which the player's rounds are to be carried out
* directions as to the order in which the clue finding rounds are to be carried out
* directions as to the order in which the player's clue revelation rounds are to be carried out
* directions as to the order in which the content of each round is to be carried out
* directions as to the order in which the intended outcome is to be carried out
* an overview of the plot
* information as to who did the crime, means, method, motive, and opportunity
* plot twists, complications, red herrings
* character development
* other elements of the plot
* directions to players to repeat interesting portions or what was heard
* directions to players to handle props
* directions to players to take notes
* directions to players to move from area to area based upon what is heard
* directions to players to answer questions about the material heard

Figure 4

PSYCHOLOGICALLY OPTIMIZED MYSTERY PARTY GAME

FIELD OF THE INVENTION

This invention relates generally to games and specifically to mystery role-playing games.

BACKGROUND OF THE INVENTION

The mystery role-playing game is a recent invention in which players dress up and take the part of characters (often in period costume) in a mystery much like a murder mystery novel. The present invention teaches an improved mystery role-playing game.

Like a country house mystery or a locked-room murder mystery, the players are presented with a problem to be solved: a theft, a murder, or some other bizarre or unusual happening. From clues they will be given, the players will deduce the traditional elements of a mystery novel: method, motive, opportunity and in the end, the identity of the murderer (or perpetrator). Prior to the start of the game (which is normally carried out during a party) the players will be given instruction, often sealed, detailing the behavior of the character they will play, from mannerisms and knowledge up to that individual's part in the tangled plots that led up to the murder, the individual's continuing motivation during the game and so on. Since one player is the murderer, that individual may be required to "accidentally" produce clues for the other players and perhaps even to impede the investigation in ways laid out in the game rules. In other known game mechanics, even the individual playing the murderer/criminal may be unaware of their own role until the mystery is solved, thus surprising the player with the discovery that they have been playing the murderer/criminal.

The genre still has certain problems. First of all, it requires certain minimum levels of player learning ability to successfully master the part of the characters: players must receive their instructions (normally so complex as to require an entire booklet to be mostly memorized), then must remember their part from minute to minute and recall the likely responses of their character to the activities and deductions of their fellow players. Must a clue be "accidentally" divulged now? Must some truthful detail be recalled and given in response to another player's question? When combined with the additional "mental overhead" of playing a traditional acting role such as an $18^{th}$ century English aristocrat or 1940's era fighter pilot, a large mental burden is placed upon the player. In addition, while simultaneously carrying out these tasks, the player is supposed to themselves be enjoying an evening as an amateur detective attempting to answer the question: "Whodunit?" Thus a barrier of mentation level is erected, a barrier that limits the potential of some individuals to participate and enjoy the role-playing game.

An additional problem is that one individual is normally selected by the host to play the role of the murderer/perpetrator. Obviously this is considered a "star" role for certain personality types but is an extreme embarrassment and thus a source of anxiety to other personality types. In particular, an individual's levels of self-confidence and social abilities are likely to limit that individual's ability to enjoy the game. This problem is even worse when game mechanics are structured such that even the "criminal" or "murderer" does not find out that they themselves "did it" until the conclusion of the game. But for reasons of normal social interactions (parties in honor of a particular individual, rotations of games in which all participants have equal chances to receive social recognition, increased status and/or general esteem, or as part of a planned therapy or maturation program, etc) it may be desirable that such an individual be allowed to participate.

This is related to the concern that arises when most or all of the players act as suspects or possibly criminals in a role-playing situation. This may be perfectly acceptable for adults who typically have the ability to distinguish between fantasy and reality and furthermore presumably will not alter their continuing self-image based upon a game. The appropriateness of this is questionable, however, in relation to children. Because "modeling" is such an important aspect of childhood social development, it may be contraindicated for children to play or "try on" the role of a criminal or suspect. (Modeling refers to emulating, literally modeling one's own behavior after a role model, hero, etc.) At a young age, glamorizing a criminal role and in addition literally "trying it on" besides having negative psychological effects, may be considered to be socially irresponsible.

Another problem is that regardless of intelligence or social abilities, players will occasionally "muff" their lines or clues. This can make a well designed role-playing scenario impossible to solve, resulting in general frustration until everyone gathers together with their script booklets and painfully puts all the pieces of the puzzle together in a cooperative effort. This problem is merely exacerbated for players of earlier stages of social development.

The term-of-art "mastery" is used when discussing this situation. Children gain self-esteem through growing independence and mastery over their environment. For example, whenever a child learns to ride a bike or how to spell new words, or conquer a problem of any type, that child gains self-satisfaction and self-confidence, engendering the sense of self-esteem. This principle can be applied in the game setting as well. In particular, a mystery game (which is after all a type of "puzzle" or problem to be solved) can be optimized for childhood levels of comprehension (thus making it possible for children to solve the puzzle) and optimized so as to increase the sense of self-esteem of the children participating.

It would thus be desirable to provide a mystery role-playing game optimized for individuals having all levels of social and/or intellectual development. In particular, it will be appreciated that the market for such games is greatly increased if game mechanics can be provided which allow children to enjoy a role-playing mystery game without frustration. In addition, it would be desirable to provide game mechanics for role-playing games which allow participants to receive social recognition for activities other than "being a murderer." Finally, it would be desirable to provide game methods and structures which make solution of the puzzle certain or near certain at the end of the game.

Patents relating to the game field usually deal with computer game devices and mechanisms or deal with board games or card games. Relatively small numbers deal with role playing by the players, and even fewer still with the psychological and emotional status of the players. A fair number deal with education of one type or another, albeit largely in the non-analogous field of non-role-playing board games or the non-analogous field of non-role-playing card games.

U.S. Pat. No. 6,318,723 B1 issued Nov. 20, 2001 to Kurita teaches a game in which interlocking cards are to be arranged in a manner in which like cards are grouped. No role playing is involved at all.

U.S. Pat. No. 6,139,016 issued Oct. 31, 2000 to Plato teaches a board game in which players advance tokens based upon correctly guessing the response to a scenario of other players. No role playing is involved.

U.S. Pat. Nos. 6,029,975 and 6,394,453 B1 issued Feb. 29, 2000 and May 28, 2002 to Siemers for PSYCHO-SOCIAL GAME THAT MEASURES EMOTIONAL DISTANCE BETWEEN PLAYER'S RESPONSES (both titles) teaches an educational game about human relationships in which responses are compared in terms of similarity or difference between responses.

U.S. Pat. Nos. 5,826,878 and 6,032,957 to Kiyosaki et al for APPARATUS AND METHOD OF PLAYING A BOARD GAME FOR TEACHING FUNDAMENTAL ASPECTS OF PERSONAL FINANCE, INVESTING AND ACCOUNTING and for BOARD GAME FOR TEACHING FUNDAMENTAL ASPECTS OF PERSONAL FINANCE, INVESTING AND ACCOUNTING issued Oct. 7, 1998 and Mar. 7, 2000 (and on the market as the "Cashflow" game) offer excellent teaching materials in the financial area. However, the lessons to be learned are geared to adult levels of mentation and play centers around a game board and the acquisition of a passive income greater than personal expenses; play does not center on the finding of clues and solving of a mystery. In addition, while the players play "a doctor", "a nurse" or a similar role, actual role playing by the players (acting out the character, thinking like the character, dressing like the character and similar activities) simply do not occur.

U.S. Pat. No. 5,401,032 issued to Barnhart et al for MYSTERY PUZZLE GAME teaches a non-role-playing game using chromatic filtering to reveal clues on cards which tell a story line.

U.S. Pat. Nos. 5,143,378 and 5,215,309 to Joel for HEALTH GAME (both titles) issued Sep. 1, 1992 and Jun. 1, 1993 provide valuable teaching in the area of personal health. Once again, however, play centers on acquisition of points at a game board, not on true role playing and there is no indication that the game is psychologically optimized for a target age group.

U.S. Pat. No. 5,141,235 issued Aug. 25, 1992 to Hernandez for EDUCATIONAL CARD GAME teaches an educational card game using the outlines of nations in a gin rummy type system of mechanics.

U.S. Pat. No. 5,042,816 issued Aug. 27, 1991 to Davis et al for BIBLICAL QUESTION AND ANSWER BOARD GAME teaches an educational board game in which players answer questions whose answers may be found in the Bible.

U.S. Pat. No. 4,706,960 issued to Nowacki et al for FIELDS OF LAW AND LEGAL PROCESS CARD AND BOARD GAME APPARATUS teaches law by means of an educational board game sans role-playing elements.

U.S. Pat. No. 4,637,799 issued Jan. 20, 1987 to Bouchal et al for SYSTEM AND GAME THAT STIMULATES CREATIVE AND VERBAL EXERCISE teaches a game involving a visual matrix of cards having images thereon. Play centers upon making up stories and arranging the images, not upon role-playing or problem solving.

U.S. Pat. No. 4,560,170 issued Dec. 24, 1985 to Enyi for NUKE AWARENESS GAME teaches methods negotiation in the context of an educational board game involving moving tokens and similar activities.

U.S. Pat. No. 4,443,010 issued Apr. 17, 1984 to Larwood for PSYCHIC CONNECTION GAME is a board game designed to test the psychic abilities of the players.

U.S. Pat. No. 4,216, 594 issued Aug. 12, 1980 to Farley et al for PSYCHOTHERAPEUTIC TESTING GAME teaches apparatus for providing a game playing apparatus used by a tester and a player to elicit psychological responses on the part of the player.

U.S. Pat. No. 4,124,412 issued Nov. 7, 1978 to Pavis for METHOD AND APPARATUS FOR INTERPRETIVE GAME teaches a board game involving dream interpretation.

U.S. Pat. No. 4,053,154 issued to Niemann for HOMICIDE BOARD GAME on Oct. 11, 1977 teaches a board game apparatus for solving a murder by collecting cards labeled "Weapon," "Clue" or "Motive". Role playing does not appear to be a factor in game play.

SUMMARY OF THE INVENTION

General Summary

The present invention is a mystery game system optimized for children and/or developmentally disadvantaged individuals. Various game mechanics are provided in order to provide a role-playing mystery game that is suitable in terms of level of difficulty for all participants; that does not require any participant to play the role of a criminal and/or "bad guy", that allows responsible supervision of the course of the game, that provides positive social rewards to a selected individual (for example a particular child whose birthday party is the occasion for the game), that provides a carefully structured format for progression of the game, and which includes one or more modest "physical" challenges such as hunts for treasure and/or clues.

In another embodiment, aspect and advantage of the invention, a supervisor/grown-up's guide to play may be utilized, which directs the supervisor as to the order in which the participant's rounds are to be carried out. In yet another aspect and advantage of the invention, a supervisor/grown-up's guide to play may be utilized, which directs the supervisor as to the order in which the clue finding rounds are to be carried out. In yet another aspect and advantage of the invention, a supervisor/grown-up's guide to play may be utilized, which directs the supervisor as to the content of the participant's revelations at each round and/or stage of the game, thus allowing the supervisor to verify that clues are brought out by the participants fully and in the correct order/sequence. In yet another aspect and advantage of the invention, a supervisor/grown-up's guide to play may be utilized, which provides the supervisor with an overview of the plot. The overview of the plot may include information as to "whodunit", means, method, motive, opportunity, plot twists, complications, red herrings, character development and other elements of the plot.

It is another objective and advantage of the present invention to provide a game system in which the players may be active participants in the plot, including the "back story" if any, which led up to the events being investigated, and yet in which non-player characters may play the roles having negative characteristics. In one embodiment, children may play the game as character/investigators but the parts of suspects are reserved for adults or entirely fictitious characters who are introduced through the plotline without anyone actually playing the part.

It is yet another objective of the present invention to provide a game system in which those players selected for positive social reinforcement participate in "star roles". Such star roles may include characters deeply involved in the back story, characters with a "heroic" part to play and/or "child detectives". It is yet another aspect and objective of the present invention to provide the "star role" with information to allow that individual to apparently "solve" the mystery at the end of the game. It is yet another aspect and advantage of the present invention to provide the "star role" with sufficient instruction to allow that player to partially supervise play. It is yet another aspect of the present invention to provide more than one "star role".

It is yet another embodiment of the present invention to provide the players with one and/or more than one stage of the game and/or round in which a more active form of investigation is allowed: searching for a treasure, searching for a clue, running, chasing, walking, etc.

Summary in Reference to the Claims

It is therefor one objective, advantage, aspect and embodiment of the invention to provide a mystery role-playing game for a group of players and at least one supervisor, the game comprising: at least one character role provided one to each such player; a plurality of individualized character reference materials provided to such player provided each character role, each reference material providing details of the character to play and further providing at least one clue to be revealed by that character and indications of at what time each clue is to be provided; at least one supervisor's reference material provided to such supervisor, the supervisor's reference material providing an outline of how play of the game is to be structured; an outline of a structured series of rounds in which the clues are revealed.

It is therefor another objective, advantage, aspect and embodiment of the invention to provide a mystery role-playing game wherein the game is suitable in terms of level of difficulty for all participants, including children.

It is therefor another objective, advantage, aspect and embodiment of the invention to provide a mystery role-playing game wherein the supervisor's reference material further comprises a grown-up's guide to play, which directs the supervisor as to the play of the game.

It is therefor another objective, advantage, aspect and embodiment of the invention to provide a mystery role-playing game wherein the supervisor's reference material further comprises one member of the group consisting of: information allowing such player introduction of a crime, information allowing introduction of the scene of a crime, information allowing introduction of a plurality of suspects, information allowing introduction of a background and combinations thereof, directions as to the order in which the player's rounds are to be carried out, directions as to the order in which the clue finding rounds are to be carried out, directions as to the order in which the player's clue revelation rounds are to be carried out, directions as to the order in which the content of each round are to be carried out, directions as to the order in which the intended outcome is to be carried out, an overview of the plot, information as to who did the crime, means, method, motive, opportunity, plot twists, complications, red herrings, character development and other elements of the plot, directions to players to repeat interesting portions of what was heard, directions to players to handle props, directions to players to take notes, directions to players to move from area to area based upon what is heard, directions to players to answer questions about the material heard and combinations thereof.

It is therefor another objective, advantage, aspect and embodiment of the invention to provide a mystery role-playing game wherein at least one such player is selected to be a star player and further wherein the individualized character reference material provided to the star player further comprises the supervisor's guide to play, which directs the star player as to the play of the game.

It is therefor another objective, advantage, aspect and embodiment of the invention to provide a mystery role-playing game wherein the supervisor's reference material further comprises information allowing the star player to solve the mystery for all participants.

It is therefor another objective, advantage, aspect and embodiment of the invention to provide a mystery role-playing game wherein the game is further written so as to allow the star player to easily direct play.

It is therefor another objective, advantage, aspect and embodiment of the invention to provide a mystery role-playing game wherein said structured series of rounds further comprises: rounds in which such players take part in physical activities selected from the group consisting of: searching for physical clues, finding physical clues, searching for a treasure, finding a treasure, finding some important object, chasing, walking, running, visiting a location for further activities and combinations thereof.

It is therefor another objective, advantage, aspect and embodiment of the invention to provide a mystery role-playing game further comprising a role having negative characteristics, wherein the role having negative characteristics is selected from the group consisting of: characters not played at all and introduced only through the plotline, characters played by individuals of increased maturity level, individuals played by adults and combinations thereof.

It is therefor another objective, advantage, aspect and embodiment of the invention to provide a method of playing a mystery role-playing game for a group of players and at least one supervisor, the method comprising: providing at least one character role to each such player; providing a plurality of individualized character reference materials to such players, one reference material provided per character role, each reference material providing details of the character to play and further providing at least one clue to be revealed by that character along with indications of the time each clue is to be provided; providing at least one supervisor's reference material to such supervisor, the supervisor's reference material providing an outline of how play of the game is to be structured; proceeding to play in a structured series of rounds in which the clues are revealed.

It is therefor another objective, advantage, aspect and embodiment of the invention to provide a method of playing a mystery role-playing game wherein the step of proceeding to play in a structured series of rounds further comprises discussion of the clues and wherein such discussion is directed by such supervisor using directions provided in the supervisor's reference material.

It is therefor another objective, advantage, aspect and embodiment of the invention to provide a method of playing a mystery role-playing game wherein the step of proceeding to play in a structured series of rounds further comprises rounds in which such players take part in physical activities selected from the group consisting of: searching for physical clues, finding physical clues, searching for a treasure, finding a treasure, finding some important object, chasing, walking, running, visiting a location for further activities and combinations thereof.

It is therefor another objective, advantage, aspect and embodiment of the invention to provide a method of playing a mystery role-playing game further comprising: solving such mystery during a final round of play.

It is therefor another objective, advantage, aspect and embodiment of the invention to provide a mystery role-playing game wherein the improvement comprises: writing and structuring of the game to allow participation by children.

It is therefor another objective, advantage, aspect and embodiment of the invention to provide a mystery role-playing game wherein such mystery further comprises a non-murder mystery.

It is therefor another objective, advantage, aspect and embodiment of the invention to provide a mystery role-playing game wherein the improvement comprises: writing and structuring of the game to provide active listening.

It is therefor another objective, advantage, aspect and embodiment of the invention to provide a mystery role-playing game for a group of players and at least one supervisor, the game comprising: at least one character role provided one to each such player; a plurality of individualized character reference materials provided to such player provided each character role, each reference material providing details of the character to play and further providing at least one clue to be revealed by that character and indications of at what time each clue is to be provided; an outline of a structured series of rounds in which the clues are revealed; and at least one of the individualized character reference materials provided to one such player further comprising one member selected from the group consisting of: information allowing such player to solve the mystery for all participants, information allowing such player introduction of a crime, information allowing introduction of the scene of a crime, information allowing introduction of a plurality of suspects, information allowing introduction of a background and combinations thereof.

It is therefor another objective, advantage, aspect and embodiment of the invention to provide a method of playing a mystery role-playing game further comprising: at least a second one of the individualized character reference materials provided to a second such player further comprising one member selected from the group consisting of: information allowing such player introduction of a crime, information allowing introduction of the scene of a crime, information allowing introduction of a plurality of suspects, information allowing introduction of a background and combinations thereof.

BRIEF DESCRIPTION OF THE DRAWINGS

FIG. 4 is a front view of an alternative embodiment of a booklet containing supervisor's reference materials.

DETAILED DESCRIPTION

Figure 1:
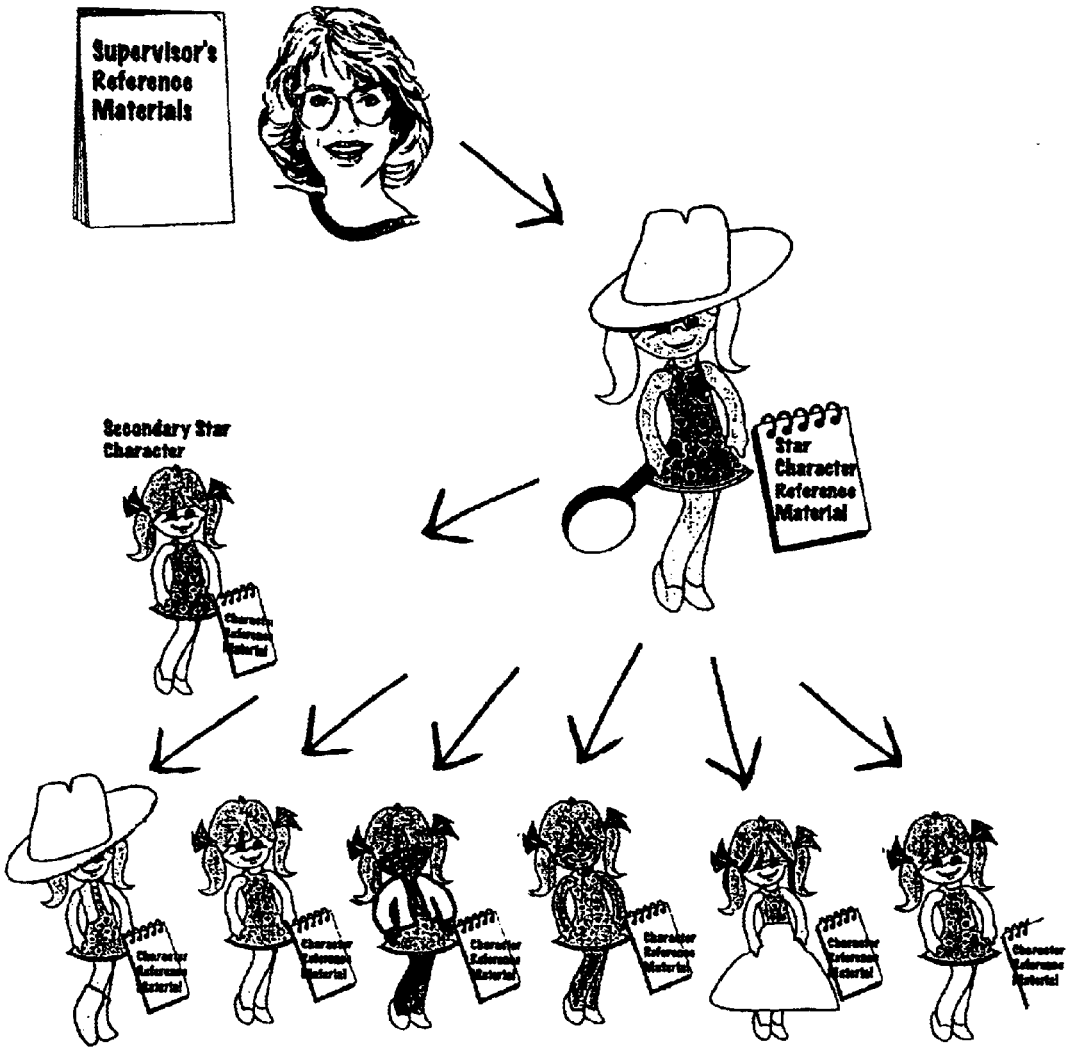
FIG. 1 is a graphical depiction of an adult supervisor and a number of children playing the roles of a star player, a secondary star player, a doctor with a lab coat as part of her role, "Caitlin Cowgirl" dressed to play her role, and other children role playing, with their respective reference materials.
Figure 2:
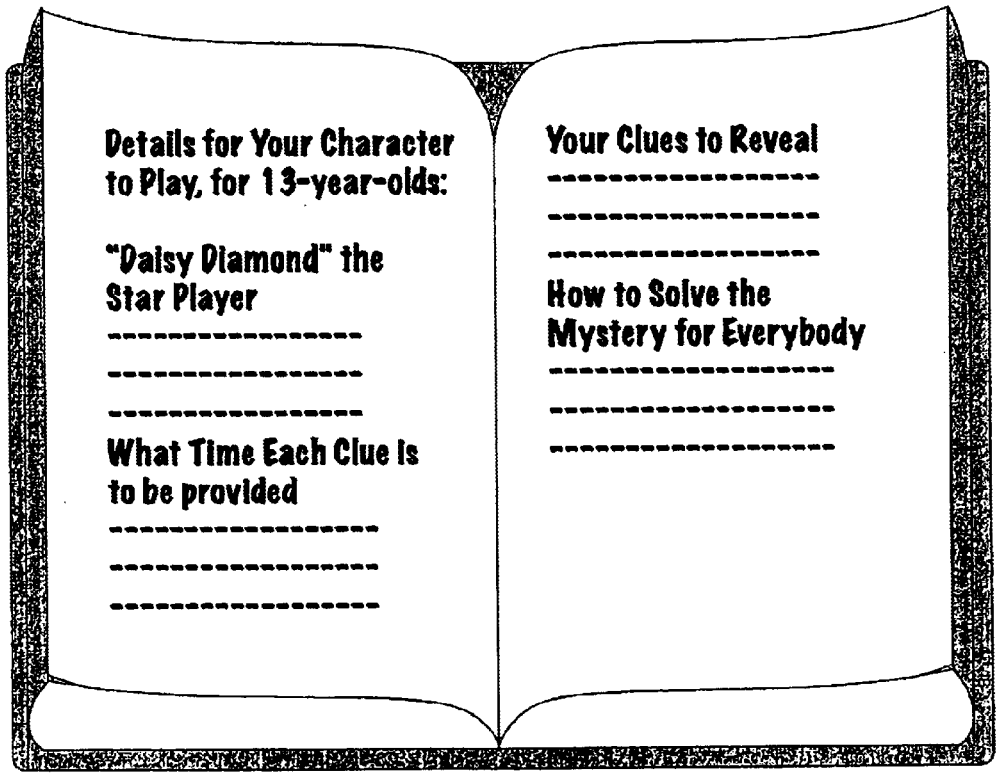
FIG. 2 is a front view of an open booklet containing an individualized character reference suitable to allow a child to play "Daisy Diamond".
Figure 3:
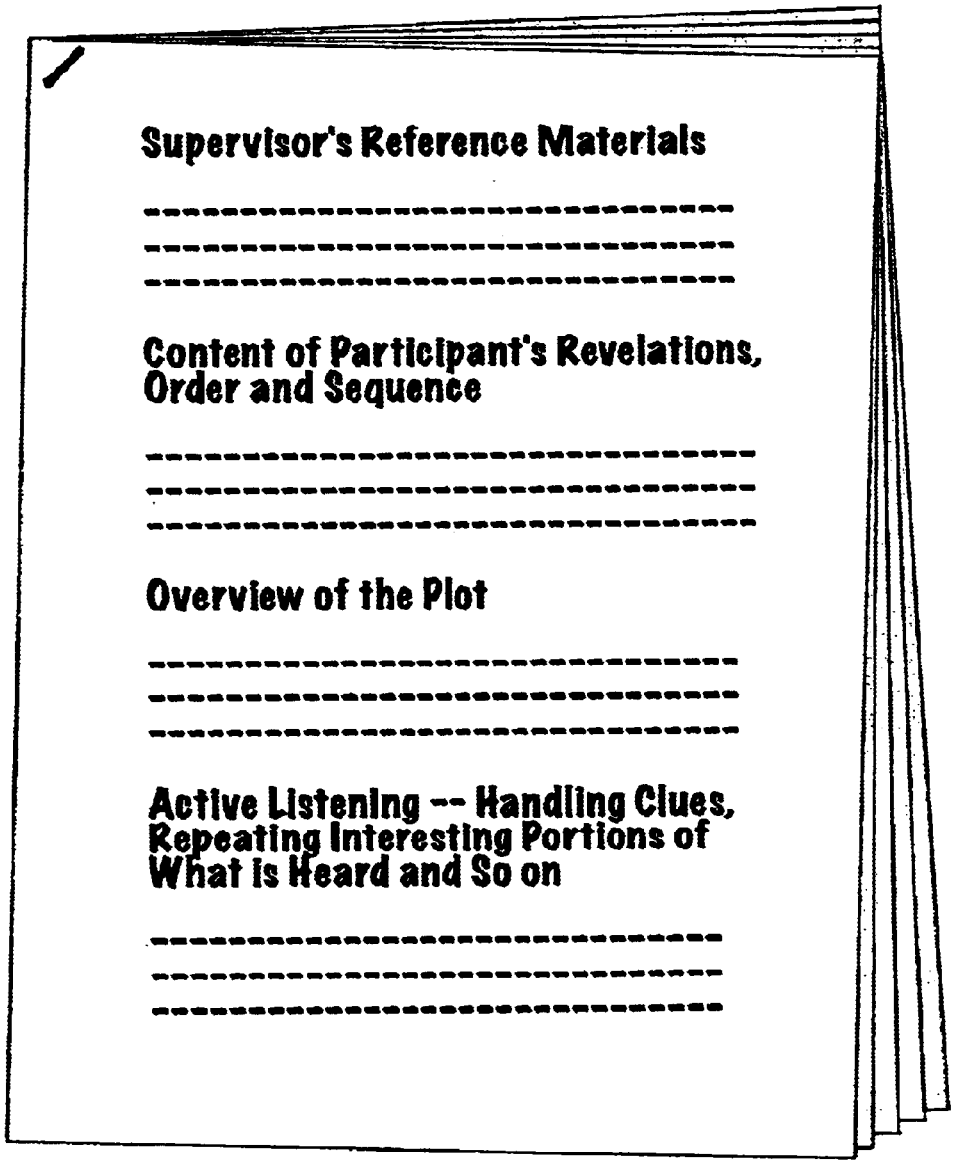
FIG. 3 is a front view of a packet containing supervisor's reference materials.
Figure 5:
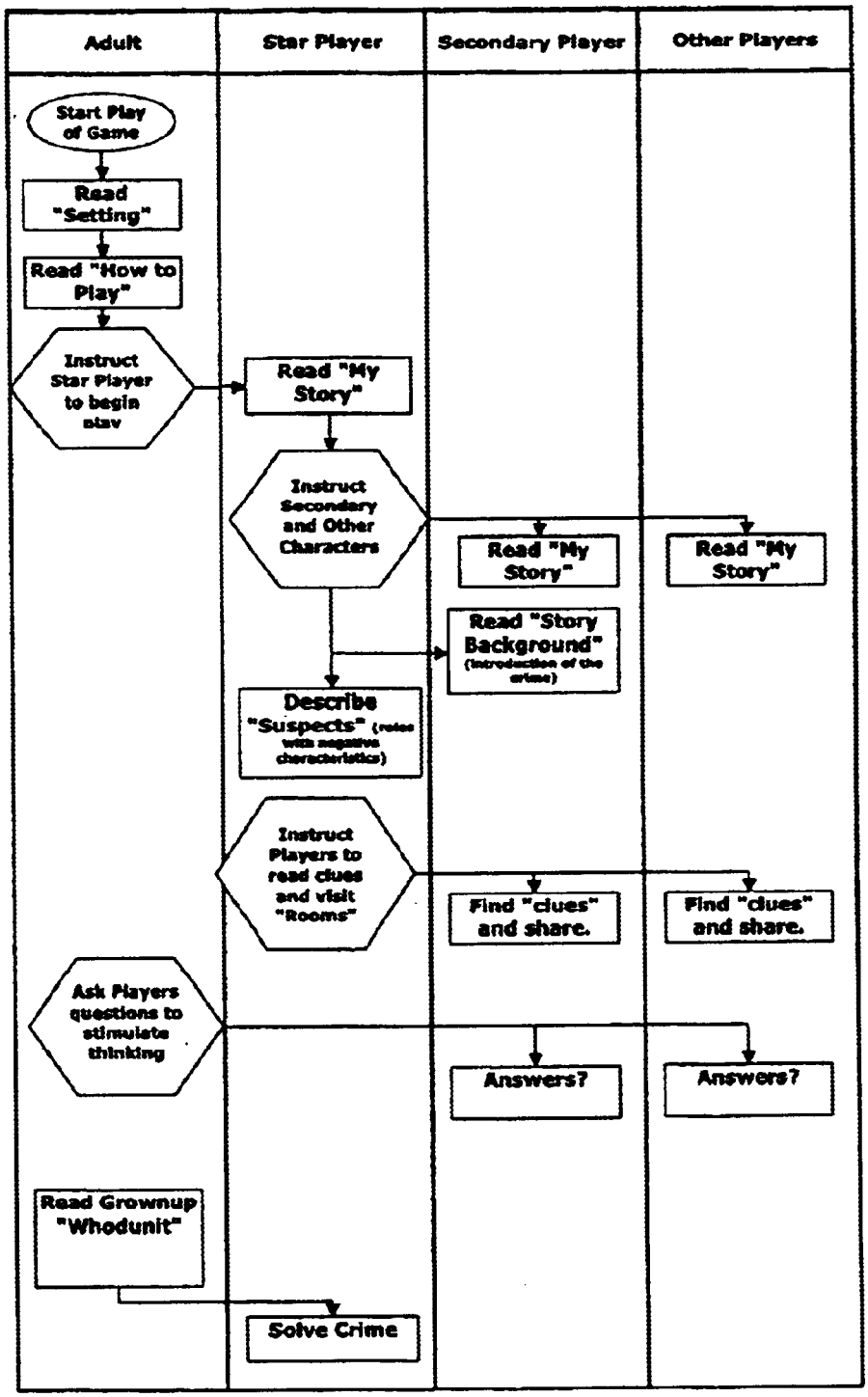
FIG. 5 is a flow chart depicting the method of play of the invention.
Figure 6:
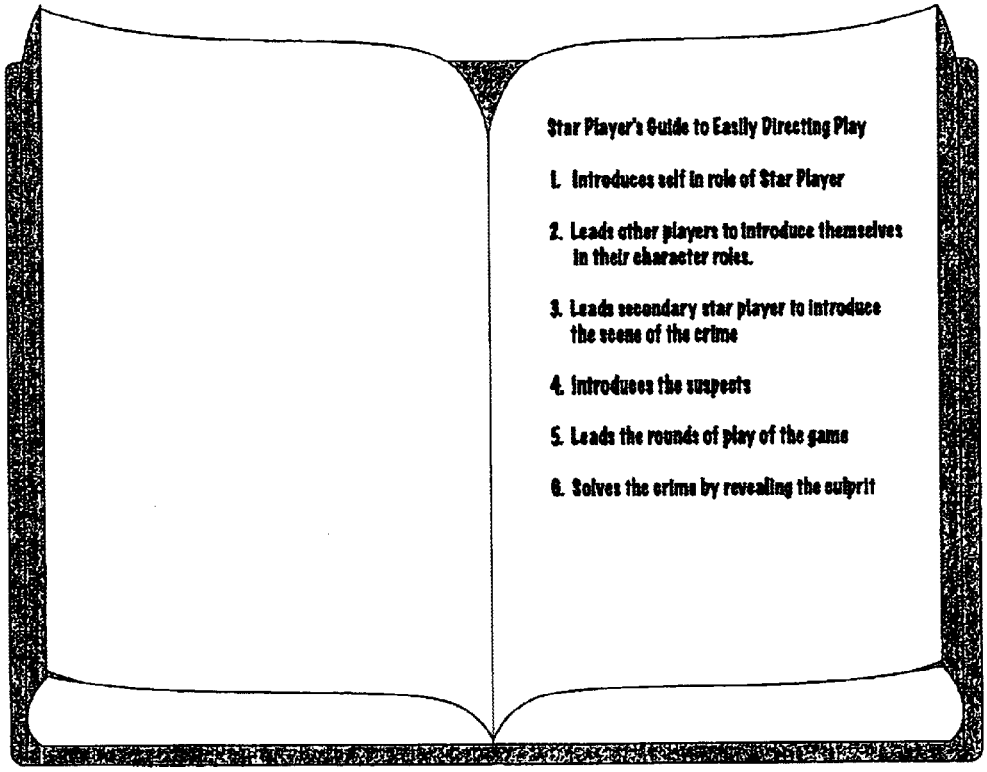
FIG. 6 is a front view of an alternative booklet embodiment of an individualized character reference suitable to allow a child to play a star player.

Game mechanics of the present invention provide a role-playing mystery game that is suitable in terms of level of difficulty for all participants including children; that does not require any participant to play the role of a criminal and/or "bad guy", that allows responsible supervision of the course of the game, that provides positive social rewards to a selected individual (for example a particular child whose birthday party is the occasion for the game), that provides a carefully structured format for progression of the game, and which includes one or more modest "physical" challenges such as hunts for treasure and/or clues. The details of writing and structuring of the game to allow participation by children are explained below.

At or prior to the beginning of play, participants will be informed of location, time, activity and most importantly, will be provided with an individualized character booklet detailing their own personal "clues" to reveal, an indication of the time to reveal each clue, and their own personal "character" to play. For children, these character roles may be simplified and well-known stereotypical types of characters. At the option of the host/hostess and participants, the participants may be asked to "dress up" a little bit, for example a participant playing a doctor might wear a lab coat and carry a black bag. Supervisors are provided with a "Supervisor's Script" and/or "Grown-up's Guide". In yet another aspect and advantage of the invention, a supervisor/grown-up's guide to play may be utilized, which directs the supervisor as to the order in which the participant's rounds are to be carried out.

The supervisor/grown-up's guide to play provides an outline of how play of the game is to be structured and directs the supervisor as to the order in which the clue finding rounds, the participant's clue revelation rounds, and the content of each round and intended outcome are to be carried out. The supervisor/grown-up's guide to play provide the supervisor with an overview of the plot. The overview of the plot may include information as to who did it ("whodunit"), means, method, motive, opportunity, plot twists, complications, red herrings, character development and other elements of the plot.

Play and revelation of clues may proceed in a structured series of rounds, thus providing game mechanics suitable for children.

Players might first engage in a round of "introductory clues" in which each player introduces their "character's" name and connection with the investigation. This material is provided in each player's individualized character reference material, usually organized in the form of a booklet, pamphlet, sheet, or other written format. A supervisor may direct this, calling on each player in turn. The supervisor in turn is coached by a "Grown-up's Guide" or by the reference material given to the "star character role", which player may supervise some or all of the rounds. Then one or more characters might introduce the problem/murder/mystery, posing the question to be solved: "Who stole the diamonds?", "Who killed the Duke of Earl?" and so on.

Thereafter a regular progression of rounds may be established by either the supervisors having "Grown-up's Guides" or the star player. In one type of typical round, the player characters (the participants, for example children) may all listen to information given about some non-player characters (plot points without actual actors/actresses representing suspects), or may listen to such non-player characters (victims, villains, and/or others played by adults or older children). Such listening may be arranged to provide "active listening sessions." Active listening, as opposed to passive listening, occurs when the listener is required to simultaneously or near simultaneously engage in activity based upon the listening. For example, the players may be required or urged by supervisors (based upon directions in the supervisor's book) to repeat the interesting portions of what is heard "Oh . . . A Glass Dagger!", or to handle props, take notes, move from area to area based upon what is heard, answer questions about the material heard and so on. The result of active listening is increased retention, not to mention increased enjoyment.

In another type of typical round, participants may refer back to their reference materials (booklets) for further clues of their own to reveal. The players may be prompted in order by a supervisor or star player to read a new short text passage from their booklet offering their own personal contribution of information. The supervisor in turn may be prompted by their own script as to the next person to be prompted or the intended content of each person's passage.

One and/or a plurality of rounds may be carried out. Such rounds may further be interspersed with clue finding rounds. It is yet another embodiment of the present invention to provide the players with one and/or more than one stage of the game and/or round in which a more active form of investigation is allowed: finding physical clues, finding a treasure, finding some important object, chasing, walking, running, visiting a location for further activities and combinations thereof, searching for a treasure, searching for a clue, running, chasing, walking, etc. One advantageous embodiment of the invention employs a verbal clue from the supervisor that a search be carried out in a specific area, after which the supervisor/star player may propose the actual search.

In embodiments of the present invention the players may be active participants in the plot, as well as active participants in revealing the plot, which may include the "back story" (if any) of the events in which characters engaged before the actual game, which events led up to or were part of the singular events now being investigated.

The non-player characters (who may be supervisor, grown-ups, hostesses, etc) may play the roles having negative characteristics. In the preferred embodiment and best mode presently contemplated, children may play the game as character/investigators but the parts of suspects are not played at all but are merely introduced through the plot. By this means, no child is "stuck" playing the part or character role of the vampire, the axe-murderer, the thief or so on. In alternative embodiments of the invention, individuals of increased maturity level (older siblings or friends, etc) may take on the negative roles.

Another important facet of the game is to provide a non-murder mystery, in embodiments. Thus, children are presented with mysteries in which there may be no actual criminals or in which the degree of criminality displayed is relatively lesser.

Further in the best mode presently contemplated and preferred embodiment of the present invention, those players selected for positive social reinforcement participate in "star roles". Such star roles may include characters deeply involved in the back story, characters with a 'heroic' part to play and/or "child detectives". It is yet another aspect and objective of the present invention to provide the "star role" with sufficient information to allow that individual to apparently "solve" the mystery at the end of the game. It is yet another aspect and advantage of the present invention to provide the "star role" with sufficient instruction to allow that player to partially supervise play. It is yet another aspect of the present invention to provide more than one "star role". For example, one "star role" may be given to the child who's birthday is being celebrated with the party at which the game occurs. A secondary star role may be provided to a child who is new in the neighborhood, has difficulties with self-image or socialization and so on.

One form of star role might be the "Girl/Boy Detective". Certain famous series of books feature children who solve mysteries. Another star role might be the individual who is most deeply involved in the back story, or who is determinedly attempting to rectify an injustice, hunt for the bad guy, or so on. At least one of the individualized character reference materials provided to one such player, the "star player", may further comprise additional information of the following types: information allowing such player to solve the mystery for all participants, information allowing such player introduction of a crime, information allowing introduction of the scene of a crime, information allowing introduction of a plurality of suspects, information allowing introduction of a background and combinations thereof. In those embodiments in which one or more secondary star players are provided, at least a second one of the individualized character reference materials provided to a second such player may well further comprise additional information such as information allowing such player introduction of a crime, information allowing introduction of the scene of a crime, information allowing introduction of a plurality of suspects, information allowing introduction of a background and combinations thereof.

The star role may be provided with sufficient additional information to allow that player to partially or entirely supervise certain rounds of play, thus enhancing the individual's social status and sense of mastery, thus increasing self-esteem. The star role may also be provided with a final clue revelation type round at the end of play, in which the person reads a script in which their character solves the mystery.

Example I

In one example of the present invention, a mystery game for 10 to 13 year old females is provided. The star role is that of "Daisy Diamond, Girl Detective". ("Daisy Diamond" is a Trademark of Mysteries by Vincent, LLC.)

Participants are provided with instructions on their part to play in the mystery, which has a "time machine" theme, thus allowing them to come to the party wearing appropriate attire for the character role assigned/provided. The actual booklets of individualized character reference materials, (one for each character) are not handed out until the party, to prevent the characters from accidentally revealing personal clues early. The Grown-up's Guide is read and mastered prior to the party. Each character comes from a different, easy-to-dress-for era. "Tessa Tyedye" has been brought forward in time from the 1970's, while "Caitlin Cowgirl" has been brought forward from the Old West. Other characters come from other time periods.

"Daisy Diamond's" character booklet goes to the star player, "Sally Sosmart" goes to a secondary star player. The "Daisy Diamond" booklet contains instruction allowing that player to call on other characters at the appropriate time, to ask them to reveal clues from their own booklets. This is important in terms of "mastery": there is little point in providing a star role if the child is unable to master it satisfactorily. Thus, the game is further written so as to allow the star player to easily direct play.

Play may proceed in a series of rounds. The first round features "Daisy" asking each of the players (who may number up to 8 in this example but larger numbers in other embodiments) to introduce themselves. Then "Daisy" and "Sally" will introduce four suspects in four rooms (The laboratory, the study, the parlor and the gathering room): "Sally" is deeply involved in the events. The four non-player character suspects are not played at all in this embodiment: they are introduced only through the plotline. The advantage of introduction through the plotline is that it allows one adult to supervise the entire party, without needing four additional characters.

In later rounds, characters may take turns to read aloud passages from their personalized character books, thus revealing further clues. In other types of rounds, the characters may examine the four rooms and find that pieces of paper labeled "CLUE" have been left in the rooms. Each clue may contain further information not found in any character role booklet. At the end of each round, the Grown-up in charge will direct such discussion using directions provided in the supervisor's booklet, for example by asking questions to provoke discussion among the players as to what the clues indicate. All of these activities are designed to promote active listening by all participants and maximize the chance of children feeling a sense of mastery of their roles. Thus the writing and structuring of the game provide active listening. Even more broadly, the game varies from previous games in that the writing and structuring of the game allow play by children.

In the final round, "Daisy" reads from her booklet, holding forth on how the clues reveal the exact details of the crime (a theft in this embodiment rather than a murder) and "solving" the mystery for all participants. A final round features the players locating and opening a jewelry box containing the key to the time machine. It may be possible that players with good logical skills may guess correctly the outcome prior to this time, though the mystery may not be solved for certain until "Daisy" reveals all the answers.

This disclosure is provided to allow practice of the invention by one skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood only from the following claims.

What is claimed is:

1. A method of playing a mystery game for a group of child players and at least one supervisor, the method comprising the steps of:

a) providing at least one character role to each such child player; including providing to at least one child player a star child player role;

b) providing a plurality of individualized character reference materials to such child players, one reference material provided per character role, each reference material providing details of the character to play and further providing at least one exclusive clue to be revealed by that character along with indications of the time each clue is to be provided;

c) providing at least one supervisor's reference material to such supervisor, the supervisor's reference material providing an outline of how play of the game is to be structured; wherein the supervisor's reference material further comprises information exclusively to the star child player allowing the star child player to solve the mystery for all participants;

d) proceeding to play in a structured series of rounds in which the clues are revealed and active listening is required by such child players.

2. The method of claim 1, wherein the supervisor's reference material further comprises a grown-up's guide to play, which directs the supervisor as to the play of the game.

3. The method of claim 1, wherein the supervisor's reference material further comprises one member of the group consisting of: information allowing such player introduction of a crime, information allowing introduction of the scene of a crime, information allowing introduction of a plurality of suspects, information allowing introduction of a background and combinations thereof, directions as to the order in which the player's rounds are to be carried out, directions as to the order in which the clue finding rounds are to be carried out, directions as to the order in which the player's clue revelation rounds are to be carried out, directions as to the order in which the content of each round are to be carried out, directions as to the order in which the intended outcome is to be carried out, an overview of the plot, information as to, means, method, motive, opportunity, plot twists, complications, red herrings, character development and other elements of the plot, directions to players to repeat interesting portions of what was heard, directions to players to handle props, directions to players to take notes, directions to players to move from area to area based upon what is heard, directions to players to answer questions about the material heard and combinations thereof.

4. The method of claim 1, wherein at least one such player is selected for positive social reinforcement by playing the star role.

5. The method of claim 1, wherein the game is further written so as to allow the star player to easily direct play.

6. The method of claim 1, further comprising a role having negative characteristics, wherein the role having negative characteristics is selected from the group consisting of: characters not played at all and introduced only through the plotline, characters played by individuals of increased maturity level, individuals played by adults and combinations thereof.

7. The method of playing a mystery game of claim 1, wherein the step of proceeding to play in a structured series of rounds further comprises discussion of the clues and wherein such discussion is directed by such supervisor using directions provided in the supervisor's reference material.

8. The method of playing a mystery game of claim 1, wherein the step of proceeding to play in a structured series of rounds further comprises rounds in which such players take part in physical activities selected from the group consisting of: searching for physical clues, finding physical clues, searching for a treasure, finding a treasure, finding some important object, chasing, walking, running, visiting a location for further activities and combinations thereof.

9. The method of playing a mystery game of claim 1, further comprising:

e) solving such mystery during a final round of play.

10. The method of claim 1 further comprising:

e) at least a second one of the individualized character reference materials provided to a second such player further comprising one member selected from the group consisting of: information allowing such player introduction of a crime, information allowing introduction of the scene of a crime, information allowing introduction of a plurality of suspects, information allowing introduction of a background and combinations thereof.

* * * * *